US009534450B2

(12) United States Patent
Cheng

(10) Patent No.: US 9,534,450 B2
(45) Date of Patent: Jan. 3, 2017

(54) THERMALLY STABLE POLYCRYSTALLINE COMPACTS FOR REDUCED SPALLING, EARTH-BORING TOOLS INCLUDING SUCH COMPACTS, AND RELATED METHODS

(71) Applicant: Baker Hughes Incorporated, Houston, TX (US)

(72) Inventor: Xiaomin Chris Cheng, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 504 days.

(21) Appl. No.: 13/947,723

(22) Filed: Jul. 22, 2013

(65) Prior Publication Data

US 2015/0021100 A1 Jan. 22, 2015

(51) Int. Cl.

| | |
|---|---|
| ***E21B 10/56*** | (2006.01) |
| ***B24D 18/00*** | (2006.01) |
| ***B24D 99/00*** | (2010.01) |
| ***E21B 10/567*** | (2006.01) |

(52) U.S. Cl.

CPC ..... *E21B 10/567* (2013.01); *B24D 18/0009* (2013.01); *B24D 99/005* (2013.01)

(58) Field of Classification Search

CPC ..... E21B 10/567; E21B 10/55; E21B 10/46; E21B 10/5735

See application file for complete search history.

(56) References Cited

U.S. PATENT DOCUMENTS

| | | | |
|---|---|---|---|
| 4,224,380 | A | 9/1980 | Bovenkerk et al. |
| 5,011,515 | A | 4/1991 | Frushour |
| 5,127,923 | A | 7/1992 | Bunting et al. |
| 5,172,778 | A | 12/1992 | Tibbitts |

(Continued)

FOREIGN PATENT DOCUMENTS

| | | | |
|---|---|---|---|
| AU | 2005243867 | A1 | 11/2005 |
| CA | 2566597 | A1 | 11/2005 |

(Continued)

OTHER PUBLICATIONS

Scott et al., U.S. Appl. No. 13/783,118, entitled Cutting Elements Leached to Different Depths Located in Different Regions of an Earth-Boring Tool and Related Methods, filed Mar. 1, 2013.

(Continued)

*Primary Examiner* — Jennifer H Gay
(74) *Attorney, Agent, or Firm* — TraskBritt

(57) ABSTRACT

Polycrystalline compacts include an interface between first and second volumes of a body of inter-bonded grains of hard material. The first volume is at least substantially free of interstitial material, and the second volume includes interstitial material in interstitial spaces between surfaces of the inter-bonded grains of hard material. The interface between the first and second volumes is configured, located and oriented such that cracks originating in the compact during use of the compacts and propagating along the interface generally toward a central axis of the compacts will propagate generally toward a back surface and away from a front cutting face of the compacts at an acute angle or angles. Methods of forming polycrystalline compacts involve the formation of such an interface within the compacts.

12 Claims, 8 Drawing Sheets

(56) References Cited

U.S. PATENT DOCUMENTS 5,472,376 A * 12/1995 Olmstead ..... E21B 10/5735 175/428
5,605,198 A 2/1997 Tibbitts et al.
5,669,271 A * 9/1997 Griffin ..... C04B 37/021 175/428
5,709,279 A 1/1998 Dennis
5,711,702 A 1/1998 Devlin
5,787,022 A 7/1998 Tibbitts et al.
5,829,541 A 11/1998 Flood et al.
5,862,873 A 1/1999 Matthias et al.
5,906,246 A 5/1999 Mensa et al.
5,950,747 A 9/1999 Tibbitts et al.
6,011,232 A * 1/2000 Matthias ..... E21B 10/5735 175/425
6,021,859 A 2/2000 Tibbitts et al.
6,193,001 B1 * 2/2001 Eyre ..... E21B 10/5735 175/428
6,202,772 B1 3/2001 Eyre et al.
6,601,662 B2 8/2003 Matthias et al.
6,991,049 B2 * 1/2006 Eyre ..... E21B 10/5735 175/430
7,165,636 B2 * 1/2007 Eyre ..... E21B 10/5735 175/430
7,533,740 B2 5/2009 Zhang
7,712,553 B2 5/2010 Shamburger
8,172,012 B2 5/2012 Achilles
8,197,936 B2 * 6/2012 Keshavan ..... B24D 3/06 428/212
8,277,722 B2 10/2012 DiGiovanni
8,353,371 B2 * 1/2013 Cooley ..... B24D 99/005 175/420.1
8,535,400 B2 9/2013 Belnap et al.
8,567,531 B2 10/2013 Belnap et al.
8,721,752 B2 5/2014 Fuller et al.
8,764,864 B1 * 7/2014 Miess ..... B24D 3/06 175/428
8,783,389 B2 * 7/2014 Fan ..... B24D 99/005 175/433
8,800,692 B2 * 8/2014 Scott ..... B24D 18/0009 175/379
8,821,604 B2 * 9/2014 Sani ..... B22F 7/06 175/428
8,839,889 B2 * 9/2014 DiGiovanni ..... B24D 99/005 175/433
8,899,358 B2 * 12/2014 Yu ..... B22F 3/12 175/420.2
8,978,789 B1 * 3/2015 Sani ..... E21B 10/567 175/433
8,985,248 B2 * 3/2015 DiGiovanni ..... E21B 10/5676 175/434
8,999,025 B1 * 4/2015 Miess ..... B24D 99/005 51/297
9,103,172 B1 * 8/2015 Bertagnolli ..... E21B 10/567
2001/0003932 A1 6/2001 Packer
2002/0071729 A1 6/2002 Middlemiss et al.
2002/0074168 A1 * 6/2002 Matthias ..... B22F 7/06 175/374
2002/0079140 A1 * 6/2002 Eyre ..... E21B 10/5735 175/432
2003/0037964 A1 2/2003 Sinor et al.
2003/0079918 A1 5/2003 Eyre et al.
2006/0165993 A1 7/2006 Keshavan
2007/0039762 A1 2/2007 Achilles
2008/0206576 A1 8/2008 Qian et al.
2009/0022952 A1 * 1/2009 Keshavan ..... B24D 3/06 428/141
2010/0012389 A1 1/2010 Zhang et al.
2010/0186304 A1 7/2010 Burgess et al.
2010/0236837 A1 9/2010 Achilles
2010/0320006 A1 * 12/2010 Fan ..... B24D 99/005 175/428
2011/0042149 A1 2/2011 Scott et al.
2011/0088950 A1 * 4/2011 Scott ..... C23C 30/005 175/57
2011/0120782 A1 * 5/2011 Cooley ..... B24D 99/005 175/432
2011/0171414 A1 * 7/2011 Sreshta ..... C22C 26/00 428/64.1
2011/0212303 A1 * 9/2011 Fuller ..... C22C 26/00 428/157
2011/0259642 A1 10/2011 DiGiovanni et al.
2011/0259648 A1 * 10/2011 Sani ..... B22F 7/06 175/428
2011/0266059 A1 11/2011 DiGiovanni et al.
2012/0037431 A1 * 2/2012 DiGiovanni ..... E21B 10/5676 175/428
2012/0080239 A1 4/2012 Lyons et al.
2012/0097457 A1 4/2012 Setlur et al.
2012/0103700 A1 5/2012 Lin
2012/0222363 A1 9/2012 DiGiovanni et al.
2012/0222364 A1 9/2012 Lyons et al.
2012/0225277 A1 * 9/2012 Scott ..... C22C 26/00 428/309.9
2013/0068534 A1 3/2013 DiGiovanni et al.
2013/0068537 A1 3/2013 DiGiovanni
2013/0068538 A1 3/2013 DiGiovanni et al.
2013/0092454 A1 4/2013 Scott et al.
2013/0292184 A1 11/2013 Weaver
2014/0060937 A1 3/2014 Konovalov et al.
2014/0069726 A1 3/2014 Mumma et al.
2014/0134403 A1 5/2014 Gledhill
2014/0166371 A1 6/2014 Whittaker
2015/0021100 A1 * 1/2015 Cheng ..... B24D 18/0009 175/428
2015/0129321 A1 * 5/2015 Sani ..... E21B 10/55 175/428

FOREIGN PATENT DOCUMENTS

CA 2566597 C 11/2011
EP 1750876 B1 7/2011
WO 2005110648 A2 11/2005
WO 2009024752 A2 2/2009
WO 2012145586 A1 10/2012

OTHER PUBLICATIONS

Underwood, Ervin E., Quantitative Stereology, Addison-Wesley Publishing Company, Inc., 1970, 20 pages.
DiGiovanni et al., U.S. Appl. No. 14/248,008, entitled Cutting Elements Having a Non-Uniform Annulus Leach Depth, Earth-Boring Tools Including Such Cutting Elements, and Related Methods, filed Apr. 8, 2014.
Stockey et al., U.S. Appl. No. 14/248,068, entitled Cutting Elements Including Undulating Boundaries Between Catalyst-Containing and Catalyst-Free Regions of Polycrystalline Superabrasive Materials and Related Earth-Boring Tools and Methods, filed Apr. 8, 2014.
Stockey et al., U.S. Appl. No. 14/329,380, entitled Cutting Elements Comprising Partially Leached Polycrystalline Material, Tools Comprising Such Cutting Elements, and Methods of Forming Wellbores Using Such Cutting Elements, filed Jul. 11, 2014.
Stockey, David A., U.S. Appl. No. 14/215,786, entitled Cutting Elements Having Non-Planar Cutting Faces With Selectively Leached Regions, Earth-Boring Tools Including Such Cutting Elements, and Related Methods, filed Mar. 17, 2014.

* cited by examiner

THERMALLY STABLE POLYCRYSTALLINE COMPACTS FOR REDUCED SPALLING, EARTH-BORING TOOLS INCLUDING SUCH COMPACTS, AND RELATED METHODS

FIELD

Embodiments of the present disclosure relate generally to polycrystalline compacts, such as polycrystalline diamond compacts, that have a volume that includes interstitial metal solvent catalyst material and another volume that does not include such interstitial metal solvent catalyst material, as well as to earth-boring tools including such compacts, and to related methods.

BACKGROUND

Cutting elements used in earth-boring tools often include polycrystalline diamond compact (often referred to as "PDC") cutting elements, which are cutting elements that include a volume of polycrystalline diamond material. One or more surfaces of the volume of polycrystalline diamond material define one or more cutting surfaces of the PDC cutting element. Polycrystalline diamond material is material that includes inter-bonded grains or crystals of diamond material. In other words, polycrystalline diamond material includes direct, inter-granular diamond-to-diamond atomic bonds between the grains or crystals of diamond material. The terms "grain" and "crystal" are used synonymously and interchangeably herein.

PDC cutting elements are formed by sintering and bonding together relatively small diamond grains under conditions of high temperature and high pressure in the presence of a metal solvent catalyst (for example, cobalt, iron, nickel, or alloys or mixtures thereof) to form a layer or "table" of polycrystalline diamond material on a cutting element substrate. These processes are often referred to as high-temperature/high-pressure (or "HTHP") processes. The cutting element substrate may comprise a cermet material (i.e., a ceramic-metal composite material) such as cobalt-cemented tungsten carbide. In such instances, the cobalt (or other catalyst material) in the cutting element substrate may diffuse into the spaces between the diamond grains during sintering and serve as the catalyst material for forming the inter-granular diamond-to-diamond bonds, and the resulting diamond table, from the diamond grains. In other methods, powdered catalyst material may be mixed with the diamond grains prior to sintering the grains together in an HTHP process.

Upon formation of a diamond table using an HTHP process, catalyst material may remain in interstitial spaces between the grains of diamond in the resulting polycrystalline diamond table. The presence of the catalyst material in the diamond table may contribute to thermal damage in the diamond table when the cutting element is heated during use due to friction at the contact point between the cutting element and the rock formation being cut.

PDC cutting elements in which the catalyst material remains in the diamond table are generally thermally stable up to a temperature of about 750° C., although internal stress within the cutting element may begin to develop at temperatures exceeding about 400° C. due to a phase change that occurs in cobalt at that temperature (a change from the "beta" phase to the "alpha" phase). Also beginning at about 400° C., there is an internal stress component that arises due to differences in the thermal expansion of the diamond grains and the catalyst material at the grain boundaries. This difference in thermal expansion may result in relatively large tensile stresses at the interface between the diamond grains, and may contribute to thermal degradation of the microstructure when PDC cutting elements are used in service. Differences in the thermal expansion between the diamond table and the cutting element substrate to which it is bonded may further exacerbate the stresses in the polycrystalline diamond compact. This differential in thermal expansion may result in relatively large compressive and/or tensile stresses at the interface between the diamond table and the substrate that eventually leads to the deterioration of the diamond table, causes the diamond table to delaminate from the substrate, or results in the general ineffectiveness of the cutting element.

Furthermore, at temperatures at or above about 750° C., some of the diamond crystals within the diamond table may react with the catalyst material causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide and/or carbon dioxide.

In order to reduce the problems associated with differences in thermal expansion and chemical breakdown of the diamond crystals in PDC cutting elements, so-called "thermally stable" polycrystalline diamond compacts (which are also known as thermally stable products, or "TSPs") have been developed. Such a TSP may be formed by leaching or otherwise removing the catalyst material (e.g., cobalt) out from interstitial spaces between the inter-bonded diamond crystals in the diamond table using, for example, an acid or combination of acids (e.g., aqua regia). A substantial amount of the catalyst material may be removed from the diamond table, or catalyst material may be removed from only a portion thereof. TSPs in which substantially all catalyst material has been leached out from the diamond table have been reported to be thermally stable up to temperatures of about 1,200° C. It has also been reported, however, that such fully leached diamond tables are relatively more brittle and vulnerable to shear, compressive, and tensile stresses than are non-leached diamond tables. In addition, it may be difficult to secure a completely leached diamond table to a supporting substrate. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments, the present disclosure includes a generally planar polycrystalline compact comprising a body of inter-bonded grains of hard material. The body of inter-bonded grains of hard material has a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface. The hard material of the inter-bonded grains of hard material comprises diamond or cubic boron nitride. The polycrystalline compact further includes an interstitial material. A first volume of the polycrystalline compact is at least substantially free of the interstitial material, such that voids exist in interstitial spaces between surfaces of the inter-bonded grains of hard material within the first volume. A second volume of the polycrystalline compact includes the interstitial material in interstitial spaces between surfaces of the inter-bonded grains of hard material within the second volume. An interface between the first volume and the second volume is configured, located and oriented such that at least one crack originating proximate a point of contact between the polycrystalline compact and a subterranean formation near the at least one lateral side surface of the body and propagating along the interface generally toward the central axis will propagate generally toward the second major surface of the body at an acute angle or angles to each of the first major surface and the second major surface.

In another embodiment, an earth-boring tool comprises a tool body and a plurality of cutting elements attached to the tool body, wherein at least one cutting element of the plurality of cutting elements comprises a polycrystalline compact as described in the above paragraph.

In additional embodiments, the present disclosure includes a method of forming a polycrystalline compact comprising a body of inter-bonded grains of hard material. In accordance with the method, a high-temperature/high-pressure (HTHP) sintering process is used to form a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface. The hard material is selected to comprise diamond or cubic boron nitride. During the HTHP sintering process, the formation of inter-granular bonds between the inter-bonded grains of hard material is catalyzed using a catalyst, and the catalyst forms an interstitial material in the resulting body of inter-bonded grains of hard material. The interstitial material is removed from interstitial spaces between surfaces of the inter-bonded grains of hard material within the first volume, and the interstitial material is left in interstitial spaces between surfaces of the inter-bonded grains of hard material within the second volume, such that the first volume is at least substantially free of the interstitial material and voids exist in the interstitial spaces between surfaces of the inter-bonded grains of hard material within the first volume. An interface is formed between the first volume and the second volume that is configured, located and oriented such that at least one crack originating proximate a point of contact between the polycrystalline compact and a subterranean formation near the at least one lateral side surface of the body, and propagating along the interface generally toward the central axis, will propagate generally toward the second major surface at an acute angle or angles to each of the first major surface and the second major surface.

BRIEF DESCRIPTION OF THE DRAWINGS

While the specification concludes with claims particularly pointing out and distinctly claiming what are regarded as embodiments of the invention, various features and advantages of embodiments of the disclosure may be more readily ascertained from the following description of some embodiments of the disclosure when read in conjunction with the accompanying drawings, in which:

DETAILED DESCRIPTION

Figure 1:
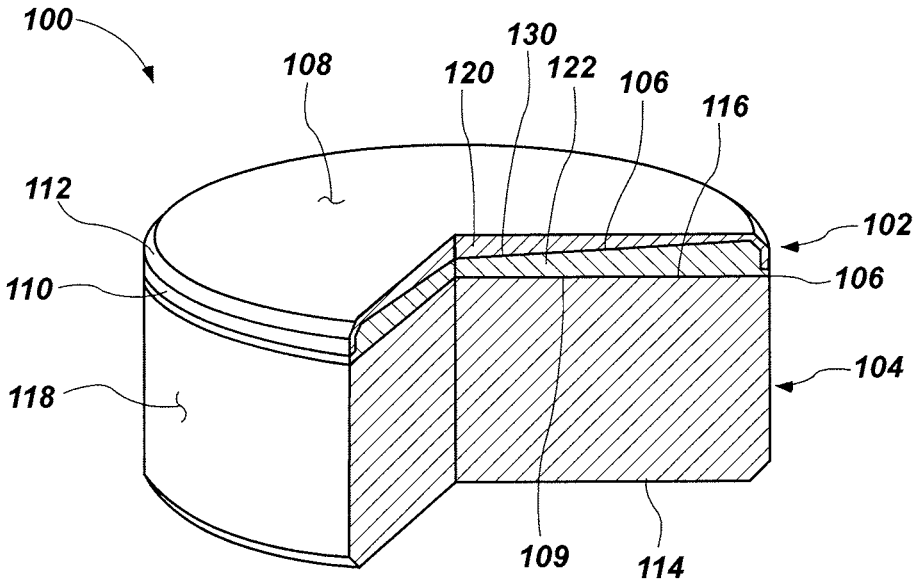
FIG. 1 is a simplified partially cut-away perspective view of an embodiment of a PDC cutting element including a generally planar polycrystalline compact of the disclosure.

The illustrations presented herein are not actual views of any particular cutting element or earth-boring tool, and are not drawn to scale, but are merely idealized representations that are employed to describe embodiments of the disclosure. Elements common between figures may retain the same numerical designation.

As used herein, relational terms, such as "first," "second," "top," "bottom," "upper," "lower," "over," "under," etc., are used for clarity and convenience in understanding the disclosure and accompanying drawings and does not connote or depend on any specific preference, orientation, or order, except where the context clearly indicates otherwise.

As used herein, the term "substantially," in reference to a given parameter, property, or condition, means to a degree that one skilled in the art would understand that the given parameter, property, or condition is met with a small degree of variance, such as within acceptable manufacturing tolerances.

As used herein, the term "configured" refers to a shape, material composition, and arrangement of one or more of at least one structure and at least one apparatus facilitating operation, response to an external stimulus, or both, of one or more of the structure and the apparatus in a pre-determined or intended way.

As used herein, the terms "earth-boring tool" means and includes any type of bit or tool used for drilling during the formation or enlargement of a wellbore in a subterranean formation and includes, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "inter-granular bond" means and includes any direct atomic bond (e.g., covalent, ionic, metallic, etc.) between atoms in adjacent grains of hard material.

As used herein, the ten "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof) and cubic boron nitride.

As used herein, the term "grain size" means and includes a geometric mean diameter measured from a 2D section through a bulk material. The geometric mean diameter for a group of particles may be determined using techniques known in the art, such as those set forth in Ervin E. Underwood, *Quantitative Stereology,* 103-105 (Addison-Wesley Publishing Company, Inc. 1970), which is incorporated herein in its entirety by this reference.

FIG. 1 is a partially cut-away perspective view of a PDC cutting element 100 that includes a generally planar polycrystalline compact 102 bonded to a supporting substrate 104 at an interface 106. In additional embodiments, the polycrystalline compact 102 may be formed and/or employed without the supporting substrate 104. As depicted in FIG. 1, the cutting element 100 may be cylindrical or disc-shaped. In additional embodiments, the cutting element 100 may have a different shape, such as a dome, cone, or chisel shape.

The supporting substrate 104 may have a first end surface 114, a second end surface 116, and a generally cylindrical lateral side surface 118 extending between the first end surface 114 and the second end surface 116. As depicted in FIG. 1, the first end surface 114 and the second end surface 116 may be substantially planar. In additional embodiments, the first end surface 114 and/or the second end surface 116 (and, hence, the interface 106 between the supporting substrate 104 and the polycrystalline compact 102) may be non-planar. In addition, as shown in FIG. 1, the supporting substrate 104 may have a generally cylindrical shape. In additional embodiments, the supporting substrate 104 may have a different shape, such as a dome, cone, or chisel shape.

The supporting substrate 104 may be formed of and include a material that is relatively hard and resistant to wear. By way of non-limiting example, the supporting substrate 104 may be formed from and include a ceramic-metal composite material (which are often referred to as "cermet" materials). In some embodiments, the supporting substrate 104 is formed of and includes a cemented carbide material, such as a cemented tungsten carbide material, in which tungsten carbide particles are cemented together in a metallic binder material. As used herein, the teem "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In at least some embodiments, the supporting substrate 104 is formed of and includes a cobalt-cemented tungsten carbide material.

Figure 2:
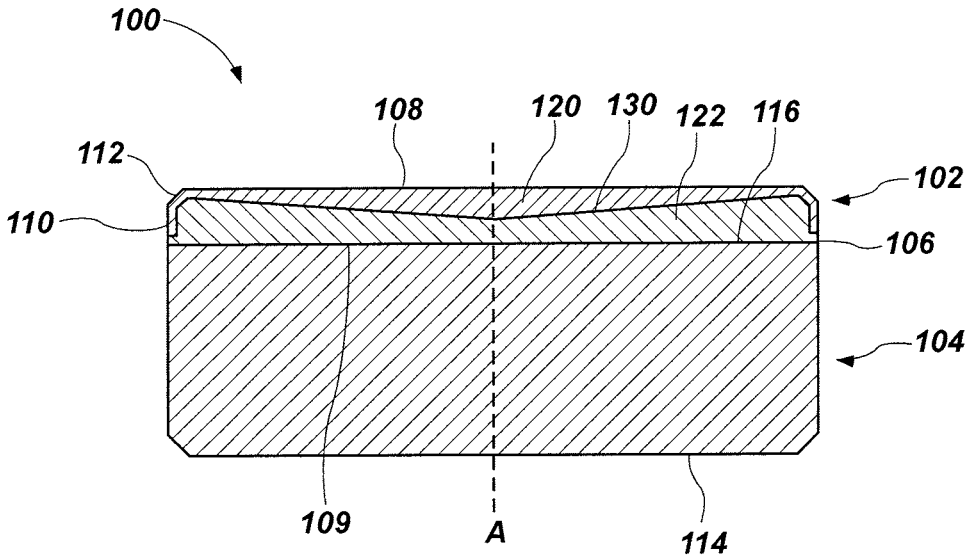
FIG. 2 is a cross-sectional side view of the PDC cutting element of FIG. 1.

The polycrystalline compact 102 may be disposed on or over the second end surface 116 of the supporting substrate 104. The polycrystalline compact 102 includes a body of inter-bonded grains of hard material, and has a first major surface 108 defining the front cutting face of the polycrystalline compact 102, a second major surface 109 on an opposing back side of the body, and at least one lateral side surface 110 extending between the first major surface 108 and the second major surface 109. As shown in FIG. 2, a central axis A may be defined that extends through a center of the body of the polycrystalline compact 102 and generally perpendicular to the first major surface 108 and the second major surface 109.

The polycrystalline compact 102 may also include a chamfered edge 112 at a periphery of the cutting face 108. The chamfered edge 112 shown in FIG. 1 has a single chamfer surface, although the chamfered edge 112 also may have additional chamfer surfaces, and such chamfer surfaces may be oriented at chamfer angles that differ from the chamfer angle of the chamfered edge 112, as known in the art. Further, in lieu of a chamfered edge 112, one or more edges of the polycrystalline compact 102 may be rounded or comprise a combination of at least one chamfer surface and at least one arcuate surface.

As illustrated in FIG. 1, the lateral side surface 110 of the polycrystalline compact 102 may be substantially coplanar with the lateral side surface 118 of the supporting substrate 104, and the cutting face 108 of the polycrystalline compact 102 may extend parallel to the first end surface 114 of the supporting substrate 104. Accordingly, the polycrystalline compact 102 may be cylindrical or disc-shaped. In additional embodiments, the polycrystalline compact 102 may have a different shape, such as a dome, cone, or chisel shape. The polycrystalline compact 102 may have a thickness within range of from about 1 millimeter (mm) to about 4 mm, such as from about 1.5 mm to about 3.0 mm. In some embodiments, the polycrystalline compact 102 has a thickness in the range of about 1.8 mm to about 2.2 mm.

The inter-bonded grains of hard material (i.e., the polycrystalline material of the polycrystalline compact 102) may comprise, for example, diamond or cubic boron nitride. The polycrystalline material may comprise more than about seventy percent (70%) by volume of the polycrystalline compact 102, more than about eighty percent (80%) by volume of the polycrystalline compact 102, or even more than about ninety percent (90%) by volume of the polycrystalline compact 102. The grains or crystals of the hard polycrystalline material are bonded together to form the polycrystalline compact 102.

Interstitial spaces or regions between the grains of hard material may be filled with an interstitial material (e.g., a metal solvent catalyst) in one or more regions of the polycrystalline compact 102, while voids may be present in the interstitial spaces or regions between the grains of hard material in one or more other regions of the polycrystalline compact 102.

The polycrystalline compact 102 may be formed using an HTHP sintering process to bond together relatively small diamond (synthetic, natural or a combination) or cubic boron nitride grains, termed "grit," under conditions of high temperature and high pressure in the presence of a catalyst (e.g., cobalt, iron, nickel, or alloys and mixtures thereof). The metal solvent catalyst material used to catalyze the formation of the inter-granular bonds between the grains of hard material may remain in interstitial spaces between the inter-bonded grains of hard material. The metal solvent catalyst material may be leached out of the interstitial spaces using, for example, an acid or combination of acids (e.g., aqua regia) to form and define first and second regions within the polycrystalline compact 102, including a first leached region and a second unleached region, as discussed in further detail below.

For example, with reference to FIGS. 1 and 2, the polycrystalline compact 102 may include a leached first volume 120 and an unleached second volume 122. The first volume 120 may comprise an outer region of the polycrystalline compact 102, and may define the entire front cutting face 108 and at least a portion (all or only a portion) of the lateral side surface 110 of the polycrystalline compact 102. The second volume 122 may comprise an inner region of the polycrystalline compact 102, and may define at least a substantial majority of the second major surface 109 of the polycrystalline compact 102.

Figure 3:
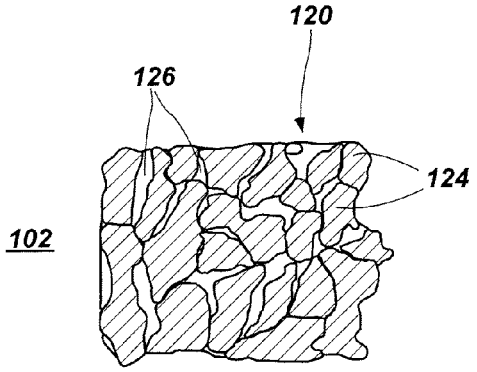
FIG. 3 is a simplified drawing illustrating how a microstructure of a first volume of the polycrystalline compact of the PDC cutting element of FIGS. 1 and 2 may appear under magnification and illustrates voids in interstitial spaces between inter-bonded grains of hard material.
Figure 4:
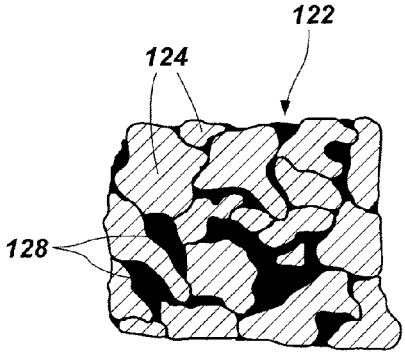
FIG. 4 is a simplified drawing illustrating how a microstructure of a second volume of the polycrystalline compact of the PDC cutting element of FIGS. 1 and 2 may appear under magnification and illustrates interstitial material in the interstitial spaces between inter-bonded grains of hard material.

FIG. 3 is a simplified figure illustrating how a microstructure of the hard polycrystalline material in the first volume 120 of the polycrystalline compact 102 may appear under magnification, and FIG. 4 is a similar figure illustrating how a microstructure of the hard polycrystalline material in the second volume 122 of the polycrystalline compact 102 may appear under magnification.

As shown in FIG. 3, the hard polycrystalline material in the first volume 120 may be at least substantially free of any interstitial material between inter-bonded grains of hard material 124, such that voids 126 are defined in the interstitial spaces between surfaces of the inter-bonded grains of hard material 124 within the first volume 120. As shown in FIG. 4, the hard polycrystalline material in the second volume 122 of the polycrystalline compact 102 includes interstitial material 128 in the interstitial spaces between surfaces of the inter-bonded grains of hard material 124 within the second volume 122.

The interstitial material 128 may comprise a metal-solvent catalyst, such as iron, cobalt, nickel, or an alloy or mixture based on one or more such elements. In other embodiments, the interstitial material 128 may comprise another metal, a ceramic material, or any other material.

Referring again to FIG. 2, in accordance with embodiments of the present disclosure, an interface 130 between the first volume 120 and the second volume 122 of the polycrystalline compact 102 is configured, located and oriented such that one or more cracks originating proximate a point of contact between the polycrystalline compact 102 and a formation near the at least one lateral side surface 110 (e.g., near the chamfered edge 112) of the body of inter-bonded grains of hard material 124 (FIGS. 3 and 4) and propagating along the interface 130 generally toward the central axis A will propagate generally toward the second major surface 109 of the body at an acute angle or angles to each of the first major surface 108 and the second major surface 109 of the polycrystalline compact 102.

Figure 5:
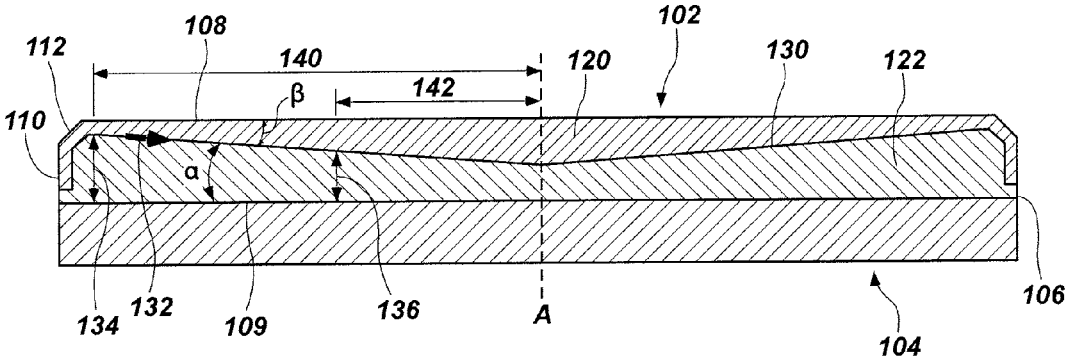
FIG. 5 is an enlarged view of a portion of the PDC cutting element of FIGS. 1 and 2 including the polycrystalline compact thereof.

FIG. 5 is an enlarged view of the polycrystalline compact 102 of the PDC cutting element 100 of FIGS. 1 and 2. As shown in FIG. 5, during use of the cutting element 100 in cutting a subterranean formation, cracks may originate within the polycrystalline compact 102 proximate the at least one lateral side surface 110 and the chamfered edge 112. Applicant has observed that such cracks may have a tendency to propagate along the interface 130 between the first region 120 and the second region 122 of the polycrystalline compact 102. Such cracks can lead to spalling of the polycrystalline material, which can reduce the efficacy of the cutting elements and, in some instances, render them unsuitable for use.

As shown in FIG. 5, according to embodiments of the disclosure, the interface 130 between the first volume 120 and the second volume 122 of the polycrystalline compact 102 is located and oriented such that the cracks propagate along the interface 130 in a direction represented by the arrow 132 generally toward the central axis A, and generally toward the second major surface 109, and at an acute angle $\alpha$ to the second major surface 109 of the polycrystalline compact 102 and an acute angle $\beta$ to the first major surface 108 of the polycrystalline compact 102. The acute angle $\alpha$ and the acute angle $\beta$ may be equal or non-equal to one another, depending on the particular configuration of the polycrystalline compact 102.

Stated another way, in some embodiments, the interface 130 between the first volume 120 and the second volume 122 may have a dish shape. Further, the interface 130 between the first volume 120 and the second volume 122 may have a smooth profile or a stepped profile in a plane containing the central axis A, such as the plane of the cross-sectional view of FIG. 2.

In this configuration, an annular portion of the interface 130 between the first volume 120 and the second volume 122 is located a distance 134 from the second major surface 109 of the body of inter-bonded grains of hard material, and regions of the interface 130 circumscribed by the annular portion are located at one or more distances 136 from the second major surface 109 of the body of inter-bonded grains of hard material. Each of the one or more distances 136 may be shorter than the first distance 134, as shown in FIG. 5.

In such embodiments, a first portion of the interface 130 between the first volume 120 and the second volume 122 is located at a first distance 134 from the second major surface 109 of the body of inter-bonded grains of hard material and at a second distance 140 from the central axis A of the body of inter-bonded grains of hard material, and a second portion of the interface 130 between the first volume 120 and the second volume 122 is located at a third distance 136 from the second major surface 109 of the body of inter-bonded grains of hard material and at a fourth distance 142 from the central axis A of the body of inter-bonded grains of hard material. As shown in FIG. 5, the first distance 134 is greater than the third distance 136, and the second distance 140 may be greater than the fourth distance 142.

As shown in FIG. 5, the first major surface 108 of the polycrystalline compact 102, which comprises a body of inter-bonded grains of hard material 124 (FIGS. 3 and 4), may comprise a surface of the first volume 120 of the polycrystalline compact 102, and the second major surface 109 of the polycrystalline compact 102 may comprise a surface of the second volume 122 of the polycrystalline compact 102. At least a portion of the at least one lateral side surface 110 of the polycrystalline compact 102 may comprise another surface of the first volume 120 of the polycrystalline compact 102. In some embodiments, only a portion of the lateral side surface 110 of the polycrystalline compact 102 extending from the chamfered edge 112 toward the interface 106 comprises a surface of the first volume 120 of the polycrystalline compact 102, and another portion of the lateral side surface 110 of the polycrystalline compact 102 adjacent the interface 106 comprises a surface of the second volume 122 of the polycrystalline compact 102. In other embodiments, the entire lateral side surface 110 of the polycrystalline compact 102 may comprise a surface of the first volume 120 of the polycrystalline compact 102, or may comprise a surface of the second volume 122 of the polycrystalline compact 102.

Additional embodiments of the present disclosure include methods of making polycrystalline compacts for cutting elements as described herein. In some embodiments, controlled leaching of interstitial material 128 (FIG. 4) of from interstitial spaces between the inter-bonded grains of hard material 124 may be used to form the first volume 120 to have a configuration as described herein. FIGS. 6A through 6F illustrate a first example of an embodiment of such a method, and FIGS. 7A through 7F illustrate another example of an embodiment of such a method.

Figure 6A:
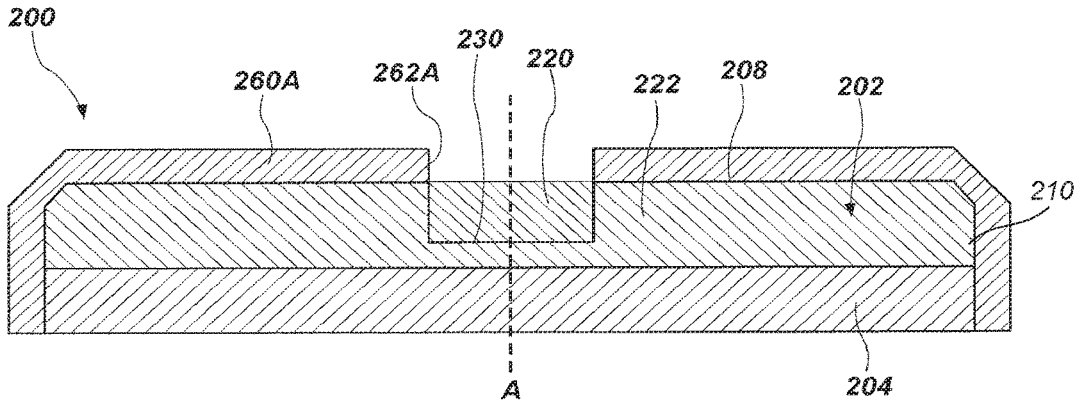
FIGS. 6A through 6F are simplified cross-sectional side views illustrating an example embodiment of a method that may be used form a polycrystalline compact of a PDC cutting element as described herein.

FIG. 6A is a simplified cross-sectional side view similar to that of FIG. 5 and illustrates a portion of a PDC cutting element 200 that includes a polycrystalline compact 202 on a substrate 204. The polycrystalline compact 202 and the substrate 204 may be as previously described in relation to the polycrystalline compact 102 and the substrate 104 with reference to FIGS. 1 through 5, with the exception that the polycrystalline compact 202 may be initially unleached, such that the entirety of the polycrystalline compact 202 includes interstitial material 128 (e.g., a metal solvent catalyst material) in the interstitial spaces between the inter-bonded grains of hard material 124 of the polycrystalline compact 202. Thus, the entire volume of the polycrystalline compact 202 may initially be like the second volume 122 of the polycrystalline compact 102 of FIGS. 1 through 5. Only a portion of the substrate 204 is shown in FIG. 6A (and FIGS. 6B through 6F), similar to the view of FIG. 5.

As shown in FIG. 6A, a patterned mask 260A may be formed over the polycrystalline compact 202. The patterned mask 260A may comprise a layer of material that is impermeable to a leaching agent used to leach interstitial material 128 out from the interstitial spaces between the grains of hard material 124 within what will become a leached first region 220 of the polycrystalline compact 202. As a non-limiting example, the patterned mask 260A may comprise a polymer material, such as an epoxy. At least one aperture 262A may be formed or otherwise provided through the patterned mask 260A, such that an area of the first major surface 208 of the polycrystalline compact 202 is exposed through the aperture 262A. The polycrystalline compact 202 then may be immersed in or otherwise exposed to an leaching agent (e.g., an acid), such that the leaching agent may be allowed to leach and remove the interstitial material 128 (e.g., metal solvent catalyst) out from the interstitial spaces between the grains of hard material 124 within the polycrystalline compact 202 and form a first region 220 within the polycrystalline compact 202. Such leaching agents are known in the art. As shown in FIG. 6A, the aperture 262A may comprise a single hole through the patterned mask 260A that is centered about (or proximate) the central axis A of the PDC cutting element 200. A second volume 222 of the polycrystalline compact 202 comprises the unleached portion of the polycrystalline compact 202. The polycrystalline compact 202 may be subjected to the leaching agent for a time sufficient to leach into the polycrystalline compact 202 to a selected depth, as measured as a distance from the first major surface 208 of the polycrystalline compact 202. After the leaching process, the patterned mask 260A may be removed.

Figure 6B:
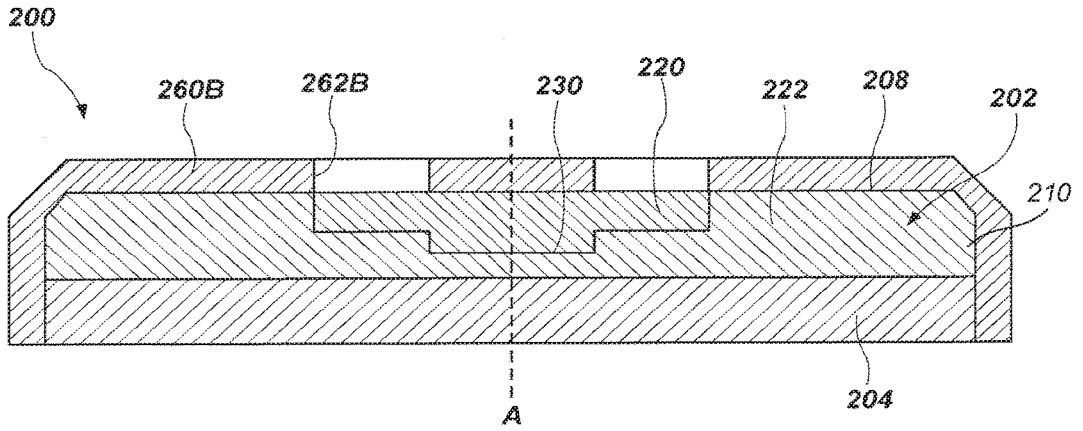

As shown in FIG. 6B, a second patterned mask 260B may be formed over the polycrystalline compact 202, which may be similar to the first patterned mask 260A, but the second patterned mask 260B may have an annular aperture 262B formed or otherwise provided through the patterned mask 260B adjacent, but located radially, circumferentially around and above the first volume 220 as formed in the first leaching process carried out as described with reference to FIG. 6A. The polycrystalline compact 202 then may be again leached through the aperture 262B so as to extend the leached portion of the polycrystalline compact 202 in the radial direction and enlarge the first volume 220 of the polycrystalline compact 202, as shown in FIG. 6B. The duration of the leaching process of FIG. 6B may be shorter than the duration of the leaching process of FIG. 6A, such that the depth of the leached portion (i.e., the first volume 220) is shallower in the regions formed by the leaching process of FIG. 6B compared to the regions formed by the leaching process of FIG. 6A.

Figure 6C:
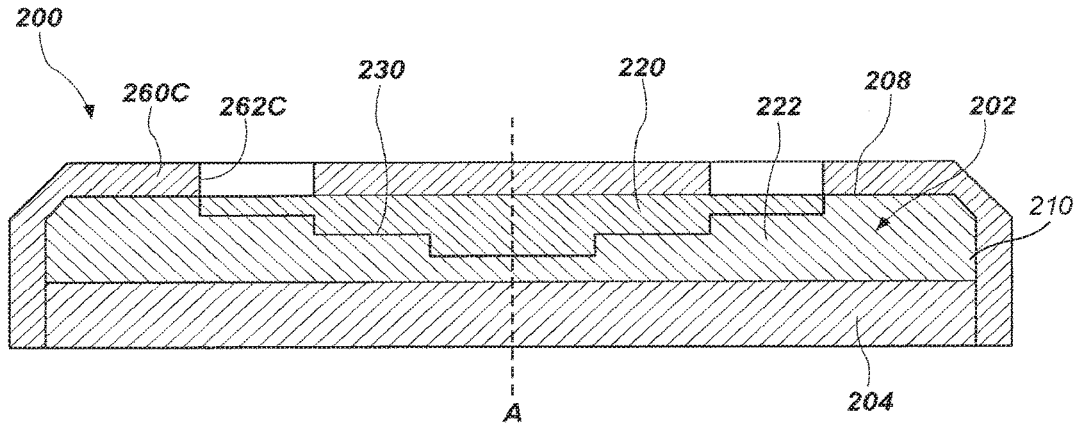
Figure 6D:
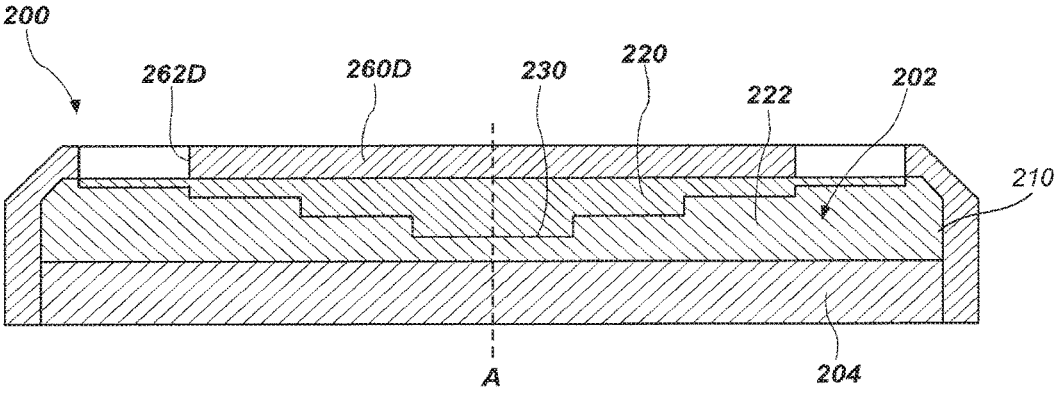
Figure 6E:
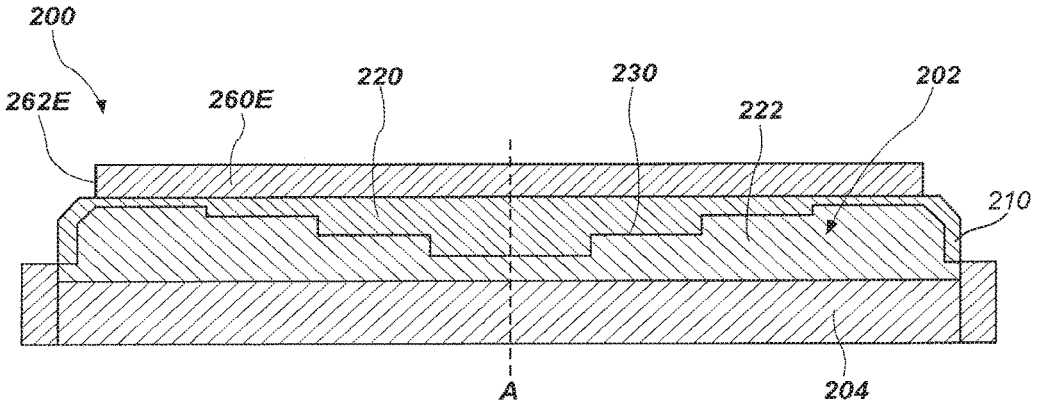
Figure 6F:
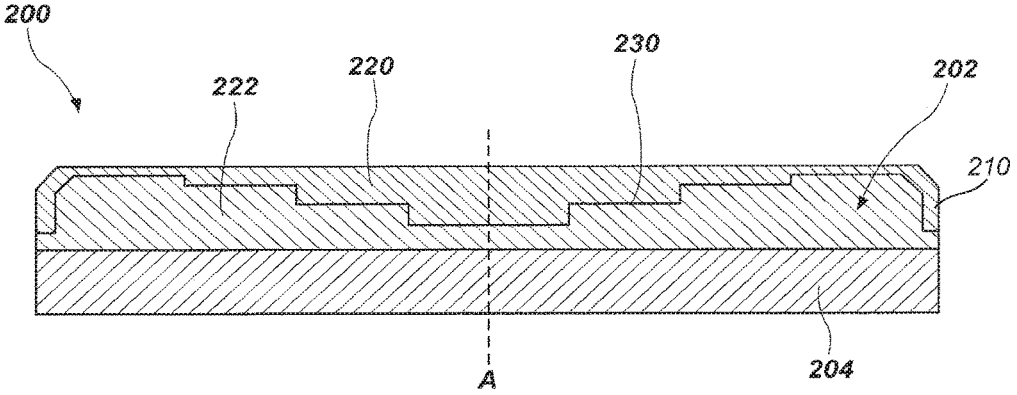
Figure 7A:
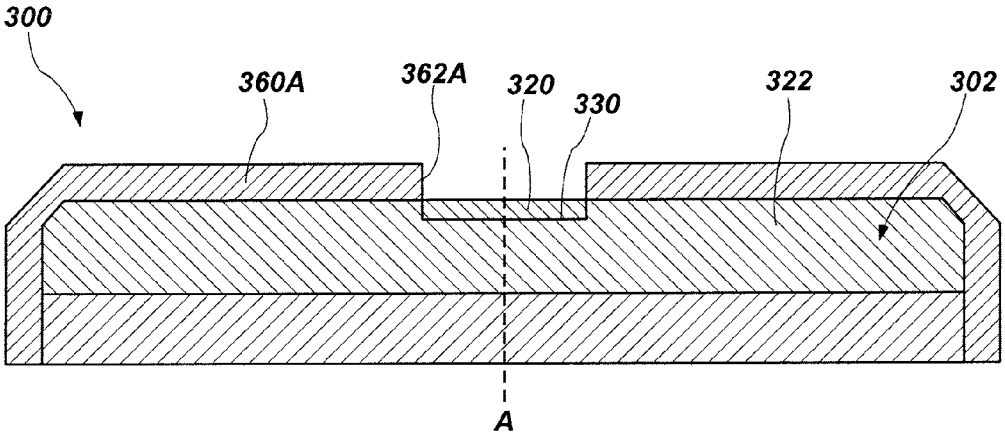
FIGS. 7A through 7F are simplified cross-sectional side views illustrating another example embodiment of a method that may be used form a polycrystalline compact of a PDC cutting element as described herein.
Figure 7B:
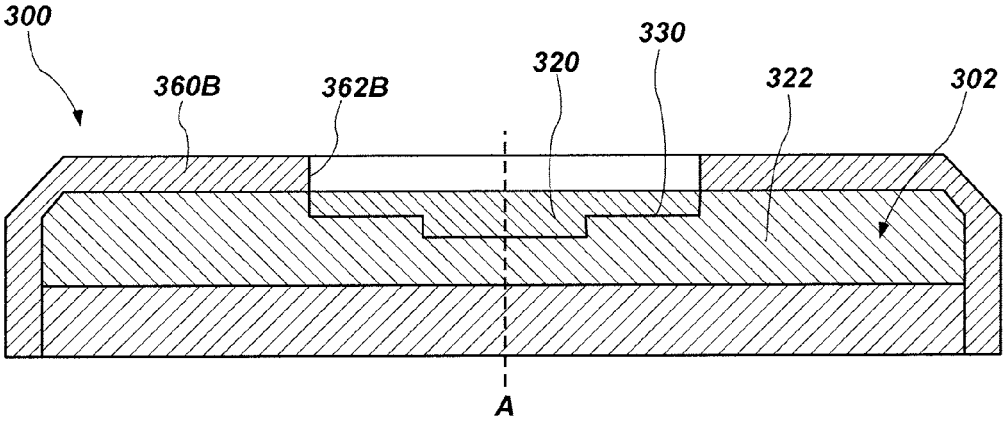
Figure 7C:
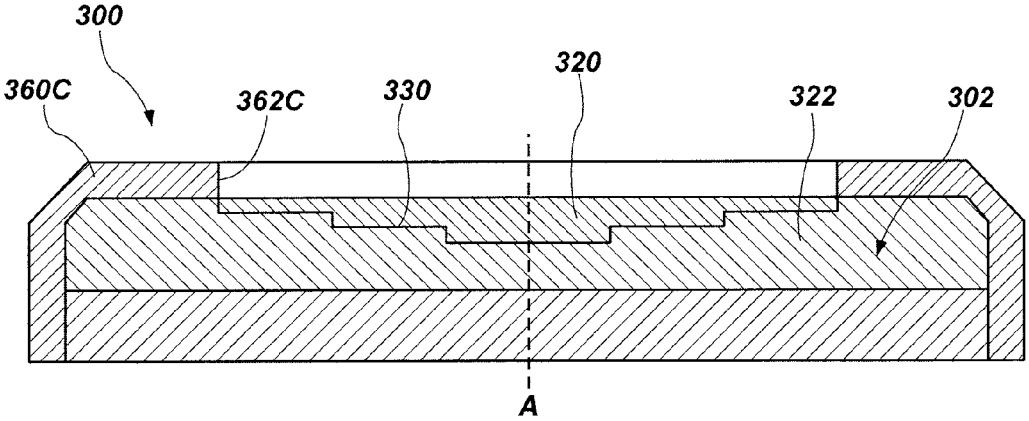
Figure 7D:
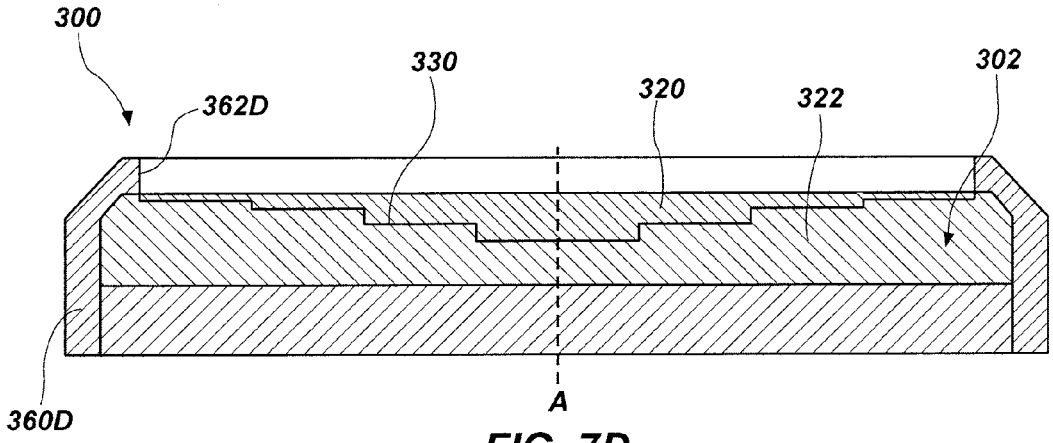
Figure 7E:
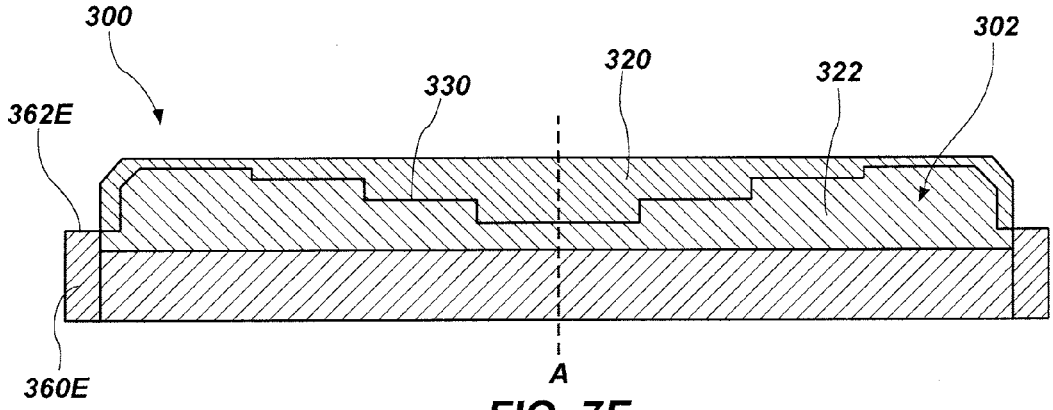
Figure 7F:
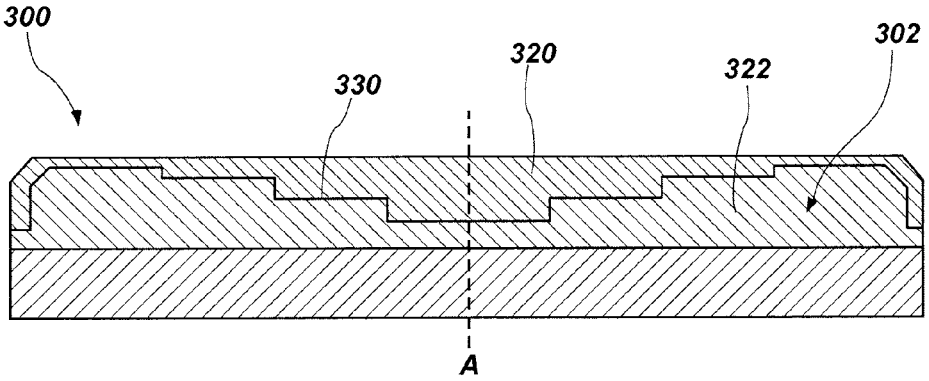

This masking and leaching process may be repeated as shown in FIGS. 6C through 6E using patterned masks 260C-260E respectively, each having an annular aperture 262C-262E of increasing radius (and distance from the central axis A). Additionally, the durations of the leaching processes may be progressively shorter to cause the leach depth, and hence, the depth of the first volume 220 to become progressively shallower moving in the radial directions extending from the central axis A toward a lateral side surface 210 of the polycrystalline compact 202. After completing the leaching processes, the last patterned mask layer may be removed to form the PDC cutting element 200 and the polycrystalline compact 202 of FIG. 6F, which is substantially similar to the PDC cutting element 100 and the polycrystalline compact 102 of FIGS. 1 through 5, but wherein an interface 230 between the first volume 220 and the second volume 222 has a stepped profile in a plane containing the central axis A, such as the plane of the cross-sectional view of FIG. 6F.

In the method described with reference to FIGS. 6A through 6F, the regions of the polycrystalline compact 202 that have been leached (e.g., the first volume 220) are substantially shielded from the leaching agent by the patterned mask layer in subsequent leaching processes, and the shape of the interface 230 is achieved by varying the durations of the different leaching processes. In additional embodiments, the shape of the interface 230 may be attained using other methods, such as by varying the strength of the leaching agent.

FIGS. 7A through 7F illustrate another method that may be used to form a PDC cutting element 300 that includes a polycrystalline compact 302 similar to those previously described herein. The method of FIGS. 7A through 7F is similar to the method of FIGS. 6A through 6F, and involves the use of sequential masking and leaching processes using patterned masks 360A-360E having apertures 362A-362E therethrough, as shown in FIGS. 7A through 7E, respectively. In the method of FIGS. 7A through 7F, however, each of the apertures 362A-362E comprises a single hole extending through each respective mask layer 360A-360E, and each of the holes has a sequentially larger diameter moving from the first patterned mask layer 360A of FIG. 7A to the last patterned mask layer 360E of FIG. 7E. In this method, the duration of each of the leaching processes is not necessarily different (they may be the same or they may be different), but previously leached portions of the polycrystalline compact 302 are not shielded from the leaching agent in subsequent leaching processes, so that the depth of the leached portions increases with each sequential leaching process in which it is exposed to a leaching agent. Thus, as shown in FIGS. 7A through 7E, the leach depth in the first volume 320 gets deeper and deeper with each sequential leaching process. After completing the leaching processes, the last patterned mask layer 360E may be removed to form the PDC cutting element 300 and the polycrystalline compact 302 of FIG. 7F, which is substantially identical to the PDC cutting element 200 of FIG. 6F, and includes an interface 330 between the first volume 320 and the second volume 322 having a stepped profile in a plane containing the central axis A, such as the plane of the cross-sectional view of FIG. 7F.

Figure 8:
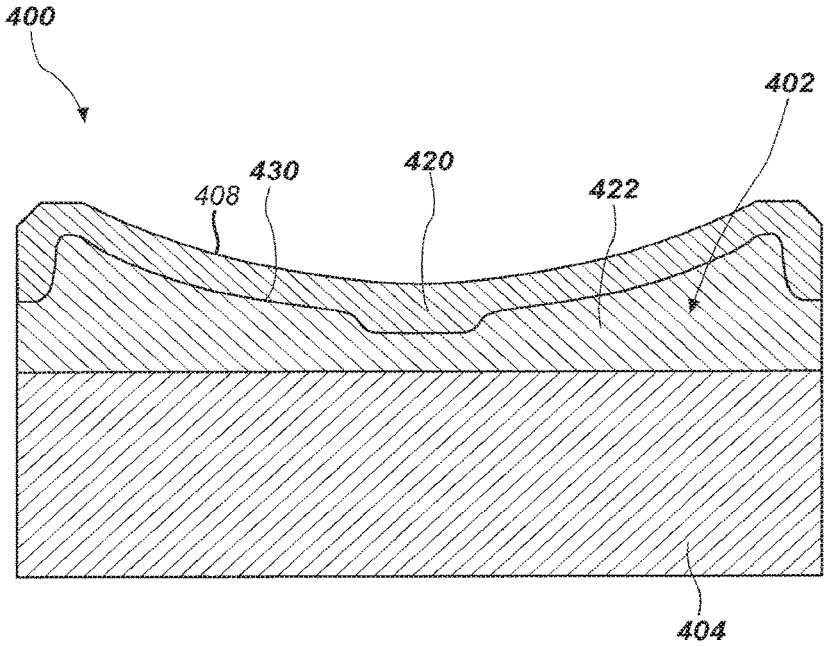
FIG. 8 is a simplified cross-sectional side view of another embodiment of a PDC cutting element including a generally planar polycrystalline compact of the disclosure.

In additional embodiments of the present disclosure, the front cutting face of a polycrystalline compact may not be planar, and the front cutting face or a central portion thereof may have a generally concave shape. In such embodiments, a single leaching process may be used to form a first leached volume and a second unleached volume within the polycrystalline compact, and the interface between the first and second volumes may have a concave shape similar to that of the interfaces previously described herein. For example, FIG. 8 illustrates a PDC cutting element 400 similar to those previously described herein. The PDC cutting element 400 includes a polycrystalline compact 402 on a substrate 404. The polycrystalline compact 402 may be as previously described, except that a central portion of a front cutting face 408 of the polycrystalline compact 402 has a concave or dish shape as shown in FIG. 8. The polycrystalline compact 402 may be leached as previously described herein, with or without the use of any mask layer or mask device, such that the entire front cutting face 408 of the polycrystalline compact 402 is subjected to the leaching agent for at least substantially the same duration of time. As a result, an interface 430 between a leached first volume 420 and an unleached second volume 422 within the polycrystalline compact 402 may have a similar concave or dished shape, similar to the shape of the interfaces 130, 230, and 330 previously described herein.

Figure 9:
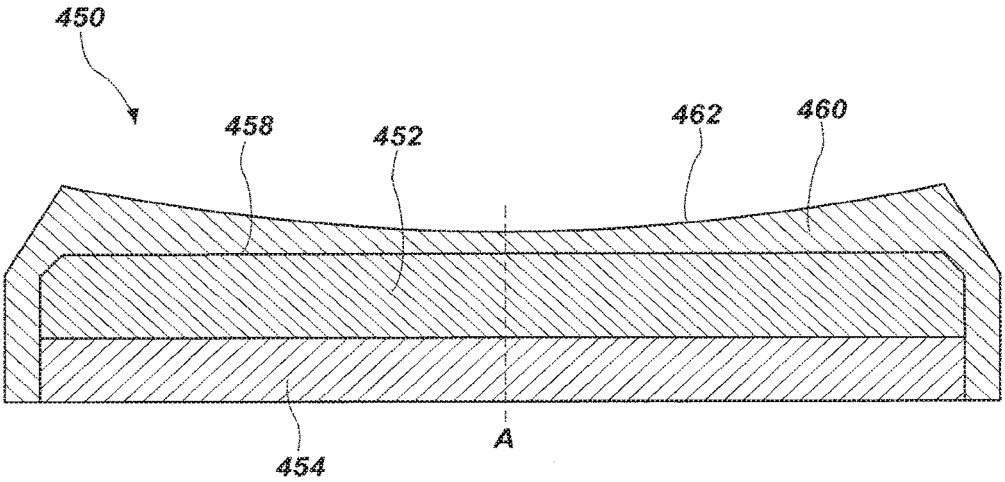
FIG. 9 is a simplified cross-sectional side view of another embodiment of a PDC cutting element including a generally planar polycrystalline compact of the disclosure and having a mask layer over the polycrystalline compact in preparation for a leaching process.

FIG. 9 is a simplified cross-sectional side view similar to those of FIGS. 6A-6F and 7A-7F, and illustrates another embodiment of a PDC cutting element 450 that includes a generally planar polycrystalline compact 452 on an end of a substrate 454. The PDC cutting element 450 is shown in FIG. 9 with a mask layer 460 over and encapsulating the polycrystalline compact 452 in preparation for a leaching process. In contrast to previous methods, however, the mask layer 460 may be permeable to a leaching agent that will be used to leach interstitial material out from interstitial spaces between grains of hard material in a region of the polycrystalline compact 452. Thus, for example, the mask layer 460 may comprise a porous polymer or ceramic material. In particular, the mask layer 460 may comprise a porous material having a three-dimensional open pore network therein, such that a leaching agent may flow through the open pore network from the exterior surfaces of the mask layer 460 to the polycrystalline compact 452. In such a configuration, the time required for the leaching agent to flow from an exterior surface of the mask layer 460 to the surface of the polycrystalline compact 452 may be at least partially a function of the distance through the mask layer 460 from the exterior surface of the mask layer 460 to the surface of the polycrystalline compact 452, and, hence, the thickness of the mask layer 460. The mask layer 460 thus may be formed to have a thickness that varies over a front cutting face 458 of the polycrystalline compact 452, as shown in FIG. 9. By way of example and not limitation, a front surface 462 of the mask layer 460 may be machined or otherwise formed, prior to the leaching process, to have a concave or dish-shaped geometry, as shown in FIG. 9. In some embodiments, the front surface 462 of the mask layer 460 may be formed to have a geometry that generally corresponds to a desired geometry of an interface between a leached region and an unleached region to be defined within the polycrystalline compact 452 by a subsequent leaching process. Thus, the front surface 462 of the mask layer 460 may have a shape as described previously in relation to the interface 130 with reference to FIGS. 1, 2, and 5 (or the shape of any other interface as described herein).

Due to the varying thickness of the mask layer 460 over the polycrystalline compact 452, the effective residence time during which any particular region of the polycrystalline compact 452 will be subjected to the leaching agent will be at least partially a function of the thickness of the mask layer 460 overlying that particular region of the polycrystalline compact 452. Regions of the polycrystalline compact 452 underlying thinner regions of the mask layer 460 will be subjected to the leaching agent for relatively longer residence times resulting in relatively deeper leaching depths therein, while regions of the polycrystalline compact 452 underlying thicker regions of the mask layer 460 will be subjected to the leaching agent for relatively shorter residence times resulting in shallower leaching depths therein. Thus, subjecting the PDC cutting element 450 of FIG. 9 with the mask layer 460 thereon to a leaching process as previously described herein may result in the formation of a leached and unleached region within the polycrystalline compact 452 with an interface therebetween having a geometry as previously described herein.

Figure 10:
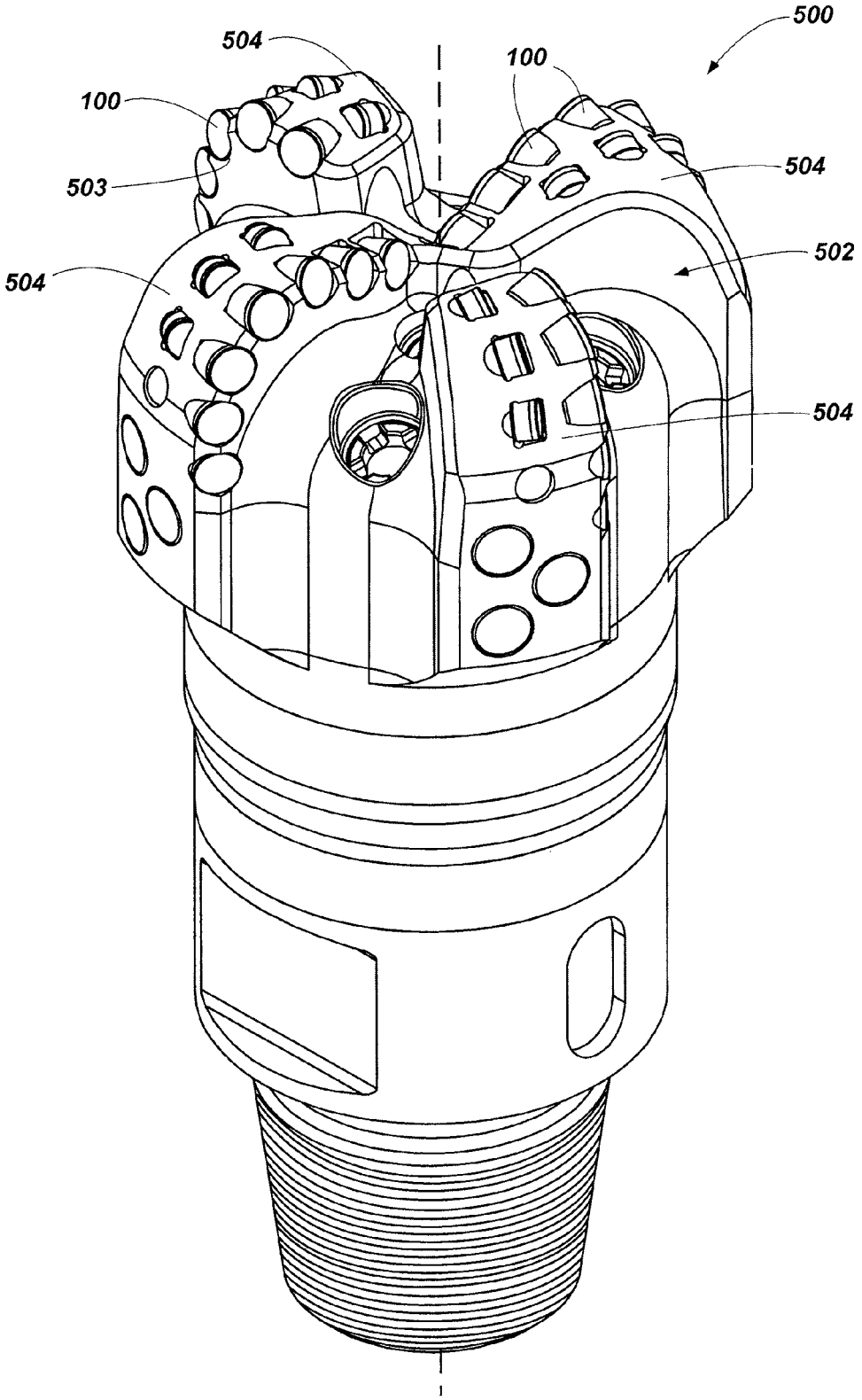
FIG. 10 is a simplified perspective view of an earth-boring tool in the form of a rotary drill bit that may include a plurality of PDC cutting elements as described herein.

Embodiments of cutting elements according to the present description, such as the PDC cutting elements 100, 200, 300, 400, may be secured to an earth-boring tool and used to remove subterranean formation material in a drilling operation or other operation used to form a wellbore in a subterranean formation. The earth-boring tool may comprise, for example, an earth-boring rotary drill bit, a percussion bit, a coring bit, an eccentric bit, a reamer tool, a milling tool, etc. As a non-limiting example, FIG. 10 illustrates a fixed-cutter type earth-boring rotary drill bit 500 that includes a plurality of PDC cutting elements 100 (FIGS. 1 through 5), each of which includes a polycrystalline compact 102 as previously described herein. The rotary drill bit 500 includes a bit body 502, and the PDC cutting elements 100 are bonded to the bit body 502. The cutting elements 100 may be brazed, welded, or otherwise secured, within pockets 503 formed in the outer surface of the bit body 502, as is known in the art. For example, the bit body 502 may include a plurality of blades 504 defining fluid courses and junk slots therebetween.

Additional non-limiting example embodiments of the disclosure are described below.

Embodiment 1

A generally planar polycrystalline compact, comprising: a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface, the hard material comprising diamond or cubic boron nitride; and an interstitial material; and wherein a first volume of the polycrystalline compact is at least substantially free of the interstitial material such that voids exist in interstitial spaces between surfaces of the inter-bonded grains of hard material within the first volume, a second volume of the polycrystalline compact includes the interstitial material in interstitial spaces between surfaces of the inter-bonded grains of hard material within the second volume, and an interface between the first volume and the second volume is configured, located and oriented such that at least one crack originating proximate a point of contact between the polycrystalline compact and a subterranean formation near the at least one lateral side surface of the body and propagating along the interface generally toward the central axis will propagate generally toward the second major surface of the body at an acute angle or angles to each of the first major surface and the second major surface.

Embodiment 2

The polycrystalline compact of Embodiment 1, wherein an annular portion of the interface between the first volume and the second volume is located a first distance from the second major surface of the body of inter-bonded grains of hard material, and regions of the interface circumscribed by the annular portion are located at one or more distances from the second major surface of the body of inter-bonded grains of hard material, each of the one or more distances being shorter than the first distance.

Embodiment 3

The polycrystalline compact of Embodiment 1 or Embodiment 2, wherein a first portion of the interface between the first volume and the second volume is located at a first distance from the second major surface of the body of inter-bonded grains of hard material and at a second distance from the central axis of the body of inter-bonded grains of hard material, and a second portion of the interface between the first volume and the second volume is located at a third distance from the second major surface of the body of inter-bonded grains of hard material and at a fourth distance from the central axis of the body of inter-bonded grains of hard material, the first distance being greater than the third distance, and the second distance being greater than the fourth distance.

Embodiment 4

The polycrystalline compact of any one of Embodiments 1 through 3, wherein at least a portion of the interface between the first volume and the second volume has substantially a dish shape.

Embodiment 5

The polycrystalline compact of any one of Embodiments 1 through 3, wherein at least a portion of the interface between the first volume and the second volume has a stepped profile in a plane containing the central axis.

Embodiment 6

The polycrystalline compact of any one of Embodiments 1 through 4, wherein at least a portion of the interface between the first volume and the second volume has a smooth profile in a plane containing the central axis.

Embodiment 7

The polycrystalline compact of any one of Embodiments 1 through 6, wherein the first major surface of the body of inter-bonded grains of hard material comprises a surface of the first volume of the polycrystalline compact.

Embodiment 8

The polycrystalline compact of any one of Embodiments 1 through 7, wherein the second major surface of the body of inter-bonded grains of hard material comprises a surface of the second volume of the polycrystalline compact.

Embodiment 9

The polycrystalline compact of any one of Embodiments 1 through 8, wherein at least a portion of the at least one lateral side surface of the body of inter-bonded grains of hard material comprises another surface of the first volume of the polycrystalline compact.

Embodiment 10

The polycrystalline compact of any one of Embodiments 1 through 9, wherein the first volume extends along the first major surface and along at least a portion of the at least one lateral side surface of the body of inter-bonded grains of hard material, and the second volume extends along the second major surface of the body of inter-bonded grains of hard material.

Embodiment 11

An earth-boring tool, comprising: a tool body; and a plurality of cutting elements attached to the tool body, wherein at least one cutting element of the plurality of cutting elements comprises a polycrystalline compact as recited in any one of Embodiments 1 through 10.

Embodiment 12

The earth-boring tool of Embodiment 11, wherein the earth-boring tool comprises at least one of a rotary drill bit for drilling a wellbore and a reamer for enlarging a wellbore.

Embodiment 13

A method of forming a generally planar polycrystalline compact, comprising: using a high-temperature/high-pressure (HTHP) sintering process to form a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface, the hard material comprising diamond or cubic boron nitride, using the high-temperature/high-pressure (HTHP) sintering process including catalyzing the formation of inter-granular bonds between the inter-bonded grains of hard material using a catalyst, the catalyst forming an interstitial material in the body of inter-bonded grains of hard material; and removing the interstitial material from interstitial spaces between surfaces of the inter-bonded grains of hard material within the first volume and leaving the interstitial material in interstitial spaces between surfaces of the inter-bonded grains of hard material within the second volume such that the first volume is at least substantially free of the interstitial material and voids exist in the interstitial spaces between surfaces of the inter-bonded grains of hard material within the first volume, and forming an interface between the first volume and the second volume configured, located and oriented such that at least one crack originating proximate a point of contact between the polycrystalline compact and a subterranean formation near the at least one lateral side surface of the body and propagating along the interface generally toward the central axis will propagate generally toward the second major surface at an acute angle or angles to each of the first major surface and the second major surface.

Embodiment 14

The method of Embodiment 13, wherein removing the interstitial material from interstitial spaces between surfaces of the inter-bonded grains of hard material within the first volume and leaving the interstitial material in interstitial spaces between surfaces of the inter-bonded grains of hard material within the second volume comprises: covering a portion of the first major surface of the body of inter-bonded grains of hard material with a first patterned mask layer; leaching a first portion of the body of inter-bonded grains of hard material through at least one aperture in the first patterned mask layer and removing the interstitial material from interstitial spaces between surfaces of the inter-bonded grains of hard material within the first portion of the body; removing the first patterned mask layer from the body; covering a portion of the first major surface of the body of inter-bonded grains of hard material with a second patterned mask layer different from the first patterned mask layer; and leaching a second portion of the body of inter-bonded grains of hard material through at least one aperture in the second patterned mask layer and removing the interstitial material from interstitial spaces between surfaces of the inter-bonded grains of hard material within the second portion of the body.

Embodiment 15

The method of Embodiment 13 or Embodiment 14, further comprising forming the interface such that an annular portion of the interface between the first volume and the second volume is located a first distance from the second major surface of the body of inter-bonded grains of hard material, and regions of the interface circumscribed by the annular portion are located at one or more distances from the second major surface of the body of inter-bonded grains of hard material, each of the one or more distances being shorter than the first distance.

Embodiment 16

The method of any one of Embodiments 13 through 15, further comprising forming the interface such that a first portion of the interface between the first volume and the second volume is located at a first distance from the second major surface of the body of inter-bonded grains of hard material and at a second distance from the central axis of the body of inter-bonded grains of hard material, and such that a second portion of the interface between the first volume and the second volume is located at a third distance from the second major surface of the body of inter-bonded grains of hard material and at a fourth distance from the central axis of the body of inter-bonded grains of hard material, the first distance being greater than the third distance, and the second distance being greater than the fourth distance.

Embodiment 17

The method of any one of Embodiments 13 through 16, further comprising forming at least a portion of the interface between the first volume and the second volume to have substantially a dish shape.

Embodiment 18

The method of any one of Embodiments 13 through 16, further comprising forming at least a portion of the interface between the first volume and the second volume to have a stepped profile in a plane containing the central axis.

Embodiment 19

The method of any one of Embodiments 13 through 16, further comprising forming at least a portion of the interface between the first volume and the second volume to have a smooth profile in a plane containing the central axis.

Embodiment 20

The method of any one of Embodiments 13 through 19, further comprising forming the first volume to extend along the first major surface and along at least a portion of the at least one lateral side surface of the body of inter-bonded grains of hard material, and forming the second volume to extend along the second major surface of the body of inter-bonded grains of hard material.

The foregoing description is directed to particular embodiments for the purpose of illustration and explanation. It will be apparent to one skilled in the art that many modifications and changes to the embodiments as set forth above are possible without departing from the scope of the embodiments disclosed herein as hereinafter claimed, including legal equivalents. For example, elements and features of one disclosed embodiment may be combined with the elements and features of other disclosed embodiments to provide further embodiments of the disclosure. It is intended that the following claims be interpreted to embrace all such modifications and changes.

What is claimed is:

1. A generally planar polycrystalline compact, comprising:

a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface, the hard material comprising diamond or cubic boron nitride; and an interstitial material; and wherein:

a first volume of the polycrystalline compact is at least substantially free of the interstitial material such that voids exist in interstitial spaces between surfaces of the inter-bonded grains of hard material within the first volume;

a second volume of the polycrystalline compact includes the interstitial material in interstitial spaces between surfaces of the inter-bonded grains of hard material within the second volume;

an interface is between the first volume and the second volume; and at least a portion of the interface has a stepped profile in a plane containing the central axis such that at least one crack originating proximate a point of contact between the polycrystalline compact and a subterranean formation near the at least one lateral side surface of the body and propagating along the interface generally toward the central axis will propagate generally toward the second major surface of the body at an acute angle or angles to each of the first major surface and the second major surface; and the at least a portion of the interface comprises:

a first annular portion centered about the central axis and having a first depth located a first distance from the second major surface of the body;

a second annular portion located radially adjacent the first annular portion and having a second depth different from the first depth located a second distance from the second major surface of the body, the second distance being greater than the first distance; and a third annular portion located radially adjacent the second annular portion and having a third depth different from the first depth and the second depth located a third distance from the second major surface of the body, the third distance being greater than the first distance and the second distance.

2. The polycrystalline compact of claim 1, wherein the first major surface of the body of inter-bonded grains of hard material comprises a surface of the first volume of the polycrystalline compact.

3. The polycrystalline compact of claim 2, wherein the second major surface of the body of inter-bonded grains of hard material comprises a surface of the second volume of the polycrystalline compact.

4. The polycrystalline compact of claim 2, wherein at least a portion of the at least one lateral side surface of the body of inter-bonded grains of hard material comprises another surface of the first volume of the polycrystalline compact.

5. The polycrystalline compact of claim 1, wherein the first volume extends along the first major surface and along at least a portion of the at least one lateral side surface of the body of inter-bonded grains of hard material, and the second volume extends along the second major surface of the body of inter-bonded grains of hard material.

6. An earth-boring tool, comprising:

a tool body; and a plurality of cutting elements attached to the tool body, wherein at least one cutting element of the plurality of cutting elements comprises a generally planar polycrystalline compact, the polycrystalline compact including:

a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface, the hard material comprising diamond or cubic boron nitride;

an interstitial material;

a first volume of the polycrystalline compact at least substantially free of the interstitial material such that voids exist in interstitial spaces between surfaces of the inter-bonded grains of hard material within the first volume;

a second volume of the polycrystalline compact including the interstitial material in interstitial spaces between surfaces of the inter-bonded grains of hard material within the second volume; and an interface between the first volume and the second volume, at least a portion of the interface having a stepped profile in a plane containing the central axis such that at least one crack originating proximate a point of contact between the polycrystalline compact and a subterranean formation near the at least one lateral side surface of the body and propagating along the interface generally toward the central axis will propagate generally toward the second major surface of the body at an acute angle or angles to each of the first major surface and the second major surface; and the at least a portion of the interface comprises:

a first annular portion centered about the central axis and having a first depth located a first distance from the second major surface of the body;

a second annular portion located radially adjacent the first annular portion and having a second depth different from the first depth located a second distance from the second major surface of the body, the second distance being greater than the first distance; and a third annular portion located radially adjacent the second annular portion and having a third depth different from the first depth and the second depth located a third distance from the second major surface of the body, the third distance being greater than the first distance and the second distance.

7. The earth-boring tool of claim 6, wherein the earth-boring tool comprises at least one of a rotary drill bit for drilling a wellbore and a reamer for enlarging a wellbore.

8. The earth-boring tool of claim 6, wherein the at least a portion of the interface between the first volume and the second volume comprises a plurality of steps, each step of the plurality of steps located radially adjacent to one another.

9. The earth-boring tool of claim 8, wherein each step of the plurality of steps has a decreasing depth with increased distance from the central axis.

10. A method of forming a generally planar polycrystalline compact, comprising:

using a high-temperature/high-pressure (HTHP) sintering process to form a body of inter-bonded grains of hard material having a first major surface defining a front cutting face of the polycrystalline compact, a second major surface on an opposing back side of the body, at least one lateral side surface extending between the first major surface and the second major surface, and a central axis extending through a center of the body and generally perpendicular to the first major surface and the second major surface, the hard material comprising diamond or cubic boron nitride, using the high-temperature/high-pressure (HTHP) sintering process including catalyzing the formation of inter-granular bonds between the inter-bonded grains of hard material using a catalyst, the catalyst forming an interstitial material in the body of inter-bonded grains of hard material;

removing the interstitial material from interstitial spaces between surfaces of the inter-bonded grains of hard material within a first volume and leaving the interstitial material in interstitial spaces between surfaces of the inter-bonded grains of hard material within a second volume such that the first volume is at least substantially free of the interstitial material and voids exist in the interstitial spaces between surfaces of the inter-bonded grains of hard material within the first volume;

forming an interface between the first volume and the second volume; and forming at least a portion of the interface to have a stepped profile in a plane containing the central axis such that at least one crack originating proximate a point of contact between the polycrystalline compact and a subterranean formation near the at least one lateral side surface of the body and propagating along the interface generally toward the central axis will propagate generally toward the second major surface at an acute angle or angles to each of the first major surface and the second major surface, surface; wherein forming the at least a portion of the interface comprises:

forming a first annular portion centered about the central axis and having a first depth located a first distance from the second major surface of the body;

forming a second annular portion located radially adjacent the first annular portion and having a second depth different from the first depth located a second distance from the second major surface of the body, the second distance being greater than the first distance; and forming a third annular portion located radially adjacent the second annular portion and having a third depth different from the first depth and the second depth located a third distance from the second major surface of the body, the third distance being greater than the first distance and the second distance.

11. The method of claim 10, wherein removing the interstitial material from interstitial spaces between surfaces of the inter-bonded grains of hard material within the first volume and leaving the interstitial material in interstitial spaces between surfaces of the inter-bonded grains of hard material within the second volume comprises:

covering a portion of the first major surface of the body of inter-bonded grains of hard material with a first patterned mask layer;

leaching a first portion of the body of inter-bonded grains of hard material through at least one aperture in the first patterned mask layer and removing the interstitial material from interstitial spaces between surfaces of the inter-bonded grains of hard material within the first portion of the body;

removing the first patterned mask layer from the body;

covering a portion of the first major surface of the body of inter-bonded grains of hard material with a second patterned mask layer different from the first patterned mask layer; and leaching a second portion of the body of inter-bonded grains of hard material through at least one aperture in the second patterned mask layer and removing the interstitial material from interstitial spaces between surfaces of the inter-bonded grains of hard material within the second portion of the body.

12. The method of claim 10, further comprising forming the first volume to extend along the first major surface and along at least a portion of the at least one lateral side surface of the body of inter-bonded grains of hard material, and forming the second volume to extend along the second major surface of the body of inter-bonded grains of hard material.

* * * * *